US006170612B1

(12) United States Patent
Krumbeck

(10) Patent No.: US 6,170,612 B1
(45) Date of Patent: Jan. 9, 2001

(54) SWIMMING POOL LIFT

(75) Inventor: Keith Krumbeck, Missoula, MT (US)

(73) Assignee: Spectrum Distributors, Inc., Missoula, MT (US)

( * ) Notice: Under 35 U.S.C. 154(b), the term of this patent shall be extended for 0 days.

(21) Appl. No.: 09/337,781

(22) Filed: Jun. 22, 1999

(51) Int. Cl.[7] ..... A47K 3/12; B66B 9/04

(52) U.S. Cl. ..... 187/200; 414/921; 4/563.1; 4/494

(58) Field of Search ..... 187/200, 272, 187/414; 414/921; 4/496, 494, 563.1, 562.1

(56) References Cited

U.S. PATENT DOCUMENTS

| | | | | |
|---|---|---|---|---|
| 2,087,286 | | 7/1937 | Hicks | 4/185 |
| 3,091,778 | | 6/1963 | Gross | 4/185 |
| 3,166,282 | | 1/1965 | Nolan | 248/124 |
| 3,286,970 | | 11/1966 | Nolan | 248/404 |
| 3,307,204 | | 3/1967 | Cotner | 4/185 |
| 3,419,044 | | 12/1968 | Daniels et al. | 137/625.69 |
| 3,815,163 | * | 6/1974 | Sullivan | 4/562.1 |
| 3,918,108 | * | 11/1975 | Feyerherm | 4/563.1 |
| 3,994,030 | | 11/1976 | Cassell et al. | 4/185 |
| 4,075,719 | | 2/1978 | Sullivan | 5/81 |
| 4,221,008 | | 9/1980 | Nolan | 4/496 |
| 4,598,432 | | 7/1986 | Pennington-Richards | 4/563 |
| 4,712,788 | * | 12/1987 | Gaudreau, Jr. | 4/563.1 X |
| 4,905,327 | * | 3/1990 | Boublil | 414/921 X |
| 4,941,216 | | 7/1990 | Boublil | 4/496 |
| 4,996,728 | | 3/1991 | Nolan | 4/496 |
| 5,103,509 | | 4/1992 | Richards | 4/564.1 |
| 5,146,638 | | 9/1992 | Richards | 5/562.1 |
| 5,218,727 | * | 6/1993 | Krumbeck | 414/921 X |
| 5,465,433 | | 11/1995 | Nolan | 4/496 |
| 5,572,921 | | 11/1996 | Krumbeck | 92/165 |

* cited by examiner

*Primary Examiner*—Robert P. Olszewski
*Assistant Examiner*—Thuy V. Tran
(74) *Attorney, Agent, or Firm*—Volpe and Koenig, P.C.

(57) ABSTRACT

A hydraulic pool lift is disclosed. The lift has enhanced stability due to its adjustable support assembly, and a reinforced piston rod. A load carrying component is rotated 180° from a deck position to a pool position. A curved track on a hydraulically driven piston guides the displacement of the load carrying component. The track is wider in its straight portions. The wider straight portion closely approximates the width of a notch in an end cap through which the track and piston travel. This arrangement affords greater stability in the uppermost position for ease of loading and unloading the lift.

19 Claims, 4 Drawing Sheets

FIG. 7
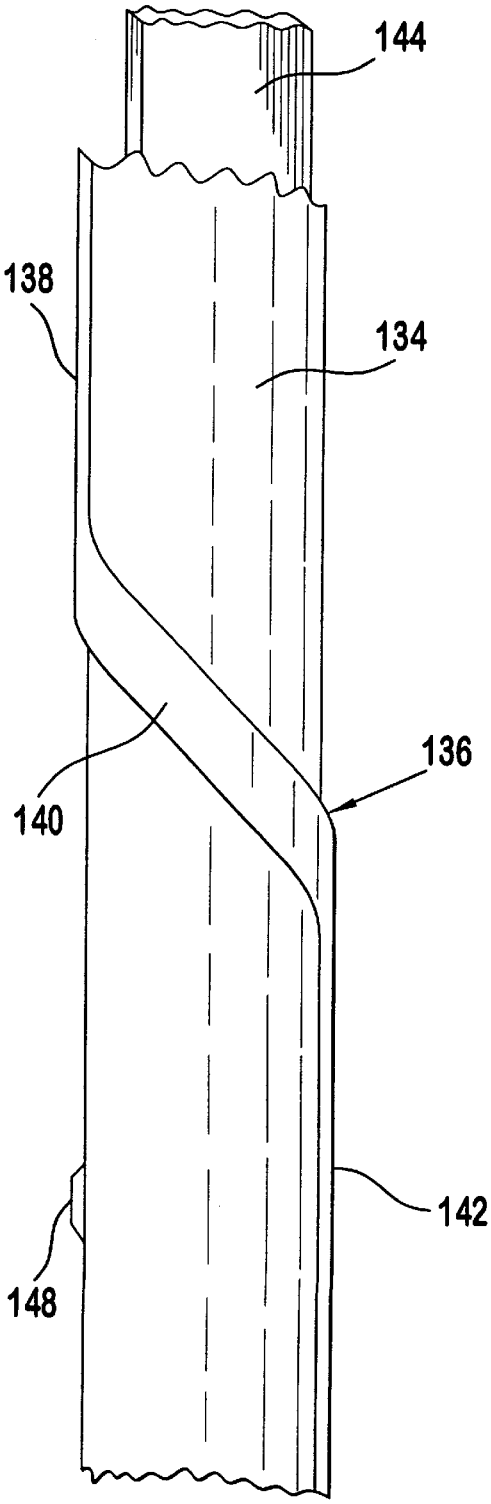
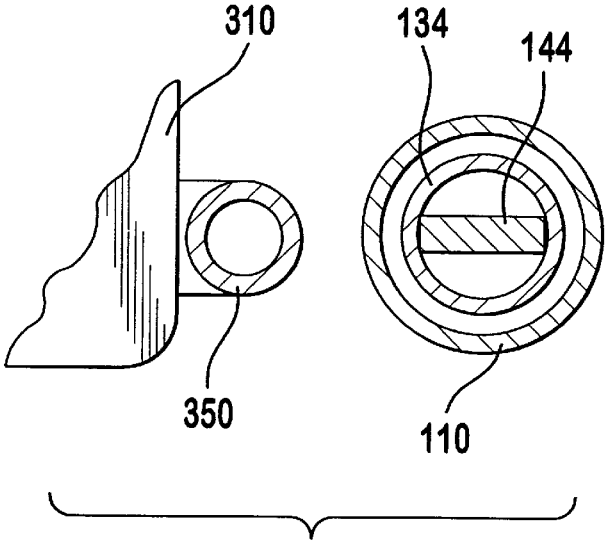
FIG. 8

SWIMMING POOL LIFT

BACKGROUND OF THE INVENTION

1. Field of The Invention

The present invention relates generally to hydraulic lifts for aiding disabled individuals. More particularly, the present invention relates to a hydraulic lift for aiding access to and egress from a swimming pool by a disabled individual.

2. Description of The Related Art

Hydraulic swimming pool lifts for the disabled are generally known in the art. Such lifts are conventionally constructed of a hydraulically driven piston within a cylinder which drives a seat portion from a lower position in the pool to a higher position above the pool. Typically, a 90° rotation is used to move the seat portion from the water area to the deck area. The cylinder is generally affixed to the deck surface by a simple bracket.

For safety and regulatory concerns it is desirable for such lifts to be able to carry and function properly with a weight three times the lift's rated capacity without permanent deformation or damage. It is common for pool lifts to be rated at four hundred pounds. Accordingly, for a lift rated at a four hundred pound capacity, it is desirable for it to function, without permanent deformation, while holding a 1,200 pound test load in all positions.

Testing reveals that many conventional lifts cannot perform adequately at three times their rated load. In fact, the performance of some lifts is questionable even at the rated capacity. When tested with a 400 pound live load, a conventional lift slowed to an unacceptable rate and required the weight to be removed in order for the lift to finish a cycle. Additionally, major structural damage even under the reduced load has been observed in testing conventional lifts. For example, the once vertical piston and cylinder bent and twisted, and were eventually displaced from the vertical by more than several degrees. During high capacity testing, the load often became unbalanced and would pull the lift out of position, creating a dangerous situation for a person in the lift, or its next occupant.

SUMMARY OF THE INVENTION

A hydraulic pool lift is disclosed. The lift has enhanced stability and adaptability due to the utilization of an adjustable support assembly, and a reinforced piston rod. The load carrying portion of the lift preferably rotates 180° in traveling from a deck loading/unloading position to a pool unloading/loading position. The deck support includes a supplemental support member disposed beneath the rotational path of the load carrying portion of the lift.

A curved track on a hydraulically driven piston guides the displacement of the load carrying portion. The track is wider in its straight portions. The wider straight portion closely approximates the width of a notch in an end cap through which the track and piston travel. This arrangement affords greater stability in the uppermost position for ease of entry into and exit from the lift portion.

It is an object of the present invention to provide a lift for access to swimming pools with improved stability that can withstand relatively high loads without loss of functionality or stability.

Other objects and advantages will be apparent to those of ordinary skill in the art from the following description of a presently preferred embodiment.

BRIEF DESCRIPTION OF THE DRAWINGS

FIG. 7 is a partial cut-away elevational view of the piston rod of the present invention.

FIG. 8 is a partial cross-sectional view of the hydraulic assembly and part of the lift assembly along lines 8—8 of FIG. 1.

DESCRIPTION OF THE PREFERRED EMBODIMENTS

Figure 1:
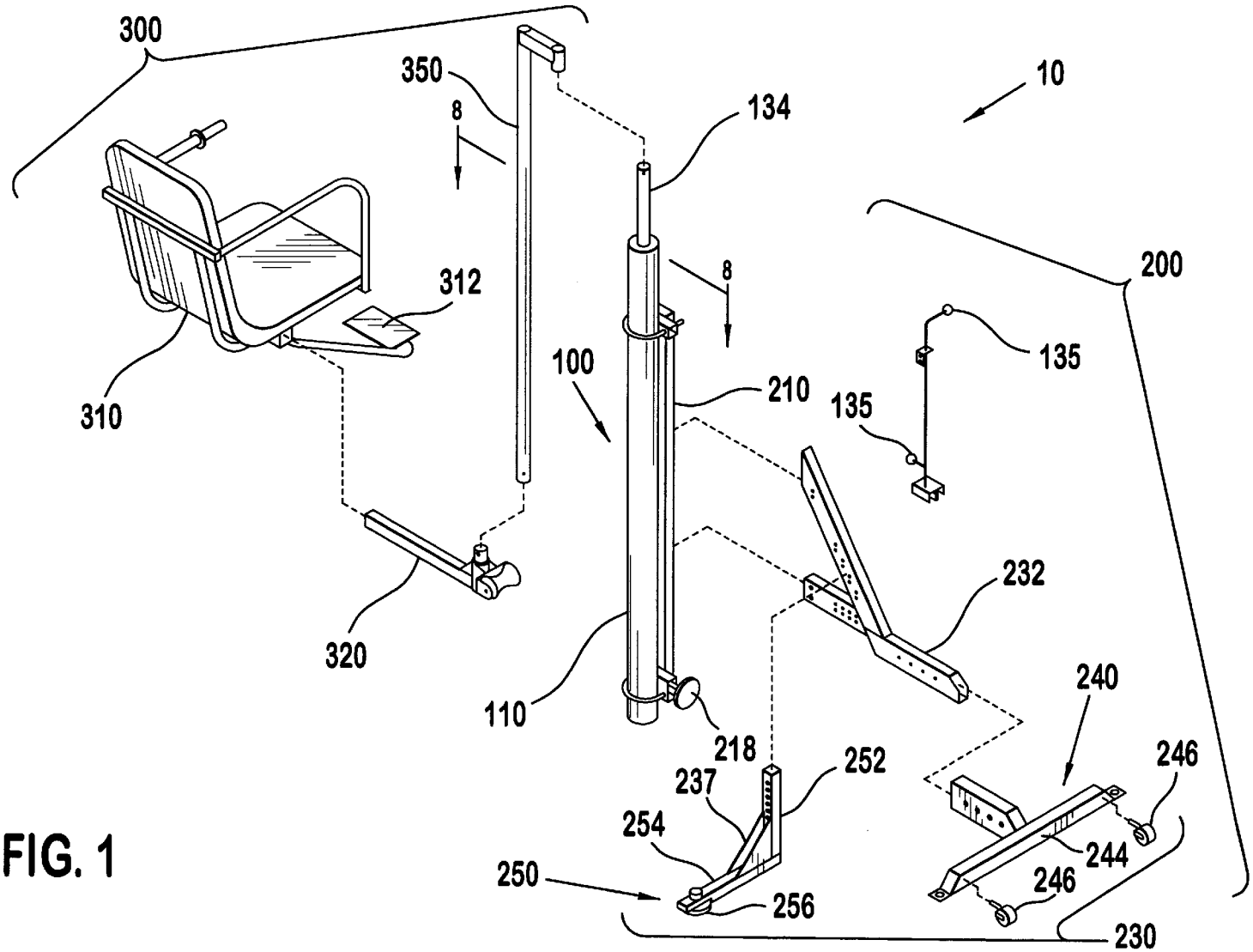
FIG. 1 is an exploded perspective view of the pool lift of the present invention.

The preferred embodiment of the present invention will be discussed with reference to the drawing figures, wherein like numerals represent like elements throughout.

Figure 4:
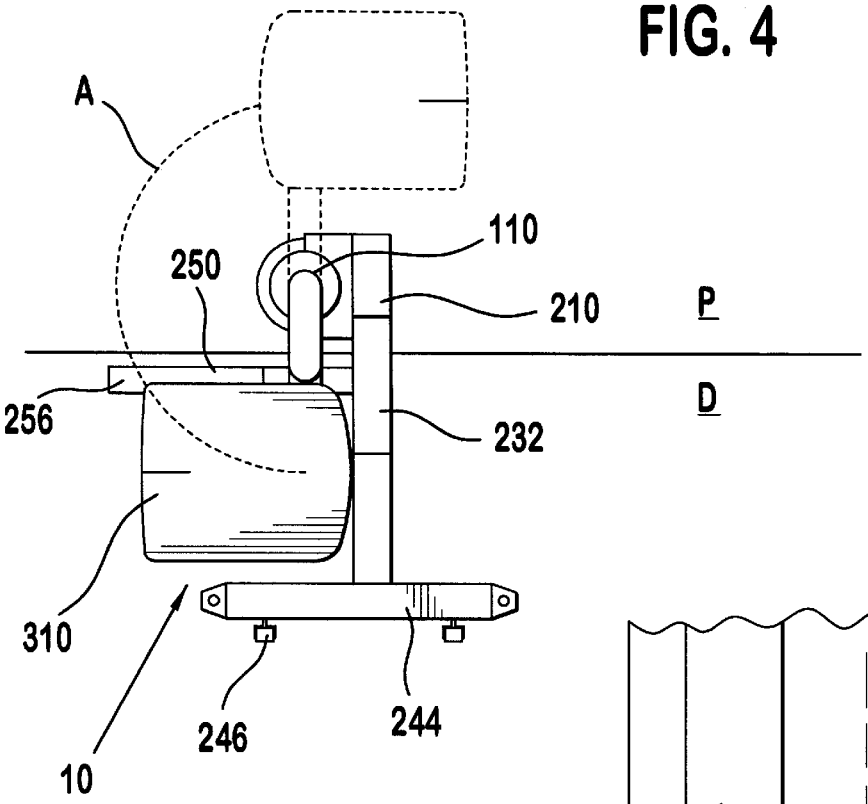
FIG. 4 is a top view of the lift system of the present invention showing the lift movement in phantom.

As seen in FIG. 1, the pool lift 10 of the present invention includes a hydraulic assembly 100, a support assembly 200, and a lift assembly 300. The hydraulic assembly 100 is used to power the lift. Preferably, water pressure is used during the raising portion and gravity during the lowering portion of a lift cycle. The support assembly 200 is used to maintain the hydraulic assembly 100 in a secure, vertical orientation throughout a full cycle of operation. The support assembly 200 also allows for vertical and lateral adjustment of the entire apparatus with respect to the pool edge and water level during installation. The lift assembly 300 is provided to carry a load and is driven by the hydraulic assembly 100 to which it is connected. In the preferred embodiment, when installed, as shown in FIG. 4, the lift assembly rotates 180° in traveling from its upper position above a pool deck D to its lower position within a pool P.

Figure 2:
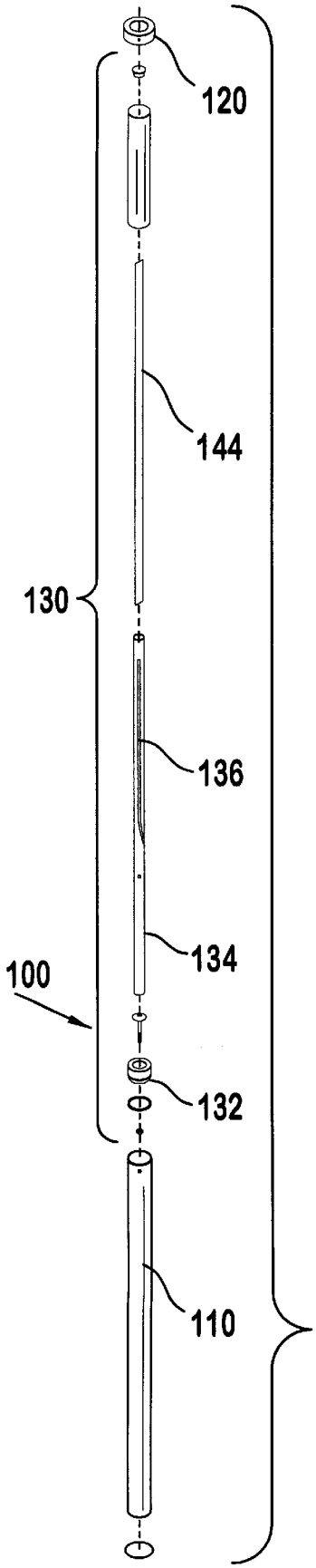
FIG. 2 is an exploded perspective view of the hydraulic assembly of the present invention.
Figure 5:
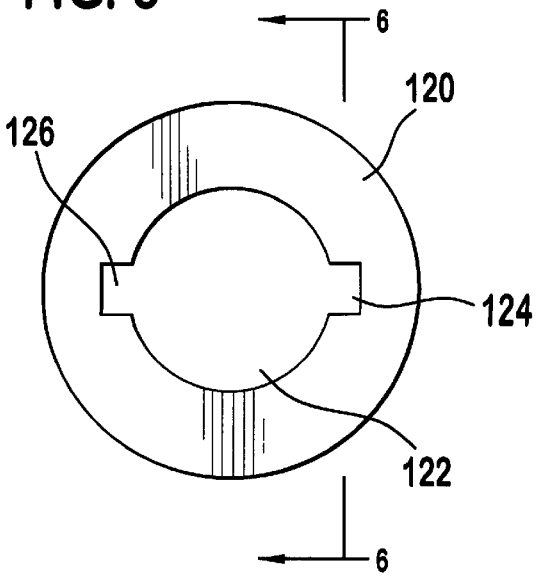
FIG. 5 is a top view of the end cap used in the hydraulic system of the present invention.

The hydraulic assembly 100, as shown in FIG. 2 includes a hollow cylinder 110 with an end cap 120 and a piston assembly 130. The hollow cylinder 110 is preferably constructed of stainless steel and is open at its upper end to accept the end cap 120 which is preferably constructed of polyolefin material. As best seen in FIG. 5, the end cap 120 includes a notched aperture 122 in which the piston assembly 130 is mounted. As best seen in FIG. 2, the piston assembly 130 includes a piston 132 attached to a piston rod 134. The piston 132 fits within the hollow cylinder 110 for vertical and radial displacement therein. The piston rod 134 is attached to the piston 132 and is adapted for displacement with the piston 132. The piston 132 is driven upward by water pressure, and allowed to fall under gravity through the opening and closing of valves, as is well known in the hydraulic arts. Preferably, the piston 132 has a substantially hemispherical shape to provide increased surface area and, accordingly, increased power when the piston is driven upwardly by the application of water pressure.

Valve control levers 135 are provided proximate both the fully raised and fully lowered positions of the lift. The control levers may either be in convenient reach of a lift occupant for facilitating self operation or may be disposed at a position remote from the lift positions so that a lift attendant's assistance is required to operate the lift.

Figure 6:
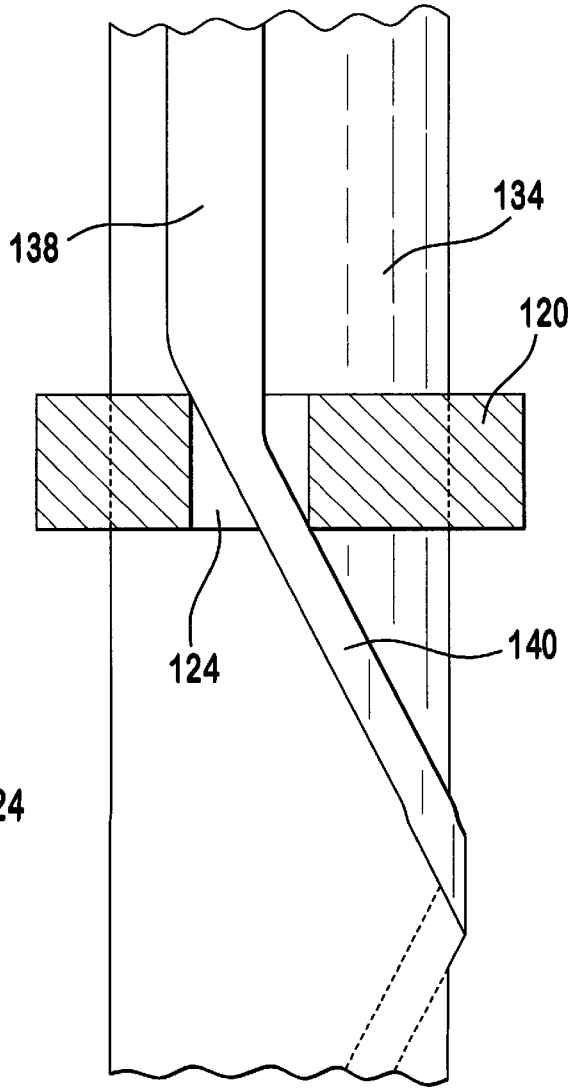
FIG. 6 is a partial cross section taken along lines of 6—6 of FIG. 5 of the end cap which also shows the raised track engaging the end cap of the hydraulic system of the present invention.

Radial displacement of the piston rod 134 through 180° is accomplished by engaging a raised track 136 on the surface of the piston rod 134 with a notch 124 of the end cap aperture 122, as shown in FIG. 6. The raised track 136 is preferably stainless steel and begins as a straight upper portion 138, curves gradually 180° around the piston rod 134 in an intermediate portion 140 and continues in a straight lower portion 142. During the lift cycle, the raised track 136 is maintained in the notch 124 of the end cap 120, which causes the piston rod 134 to radially turn as it is raised or lowered. The thickness of the end cap and the width of the notch are determined in relation to the size and pitch of the curved portion of the raised track. It should be recognized that other arrangements may be employed such as a raised track on the cylinder, etc.

In the preferred embodiment, the piston rod 134 contains an internal reinforcing bar 144 along its length. The reinforcing bar has a rectangular cross-section with a narrow side and a wide side where the narrow side faces the load as seen in FIG. 8. The reinforcing bar 144 is preferably constructed from stainless steel flatbar 1.66 inches in width and ¼ inches thick or other suitable material and helps prevent unwanted bending or twisting. The uppermost portion of the piston rod 134 is adapted for attachment to the lift assembly so that the lift assembly is displaced with the piston assembly 130.

The support assembly 200 maintains the hydraulic assembly 100 in a secure vertical orientation during lift operation. For convenient set up and installation, the support assembly 200 allows for vertical adjustment of the hydraulic assembly 100 with respect to a pool deck, various pool water levels and for lateral adjustment with respect to a pool wall. The support assembly 200 includes a vertical support column 210 and a deck support 230.

Figure 3:
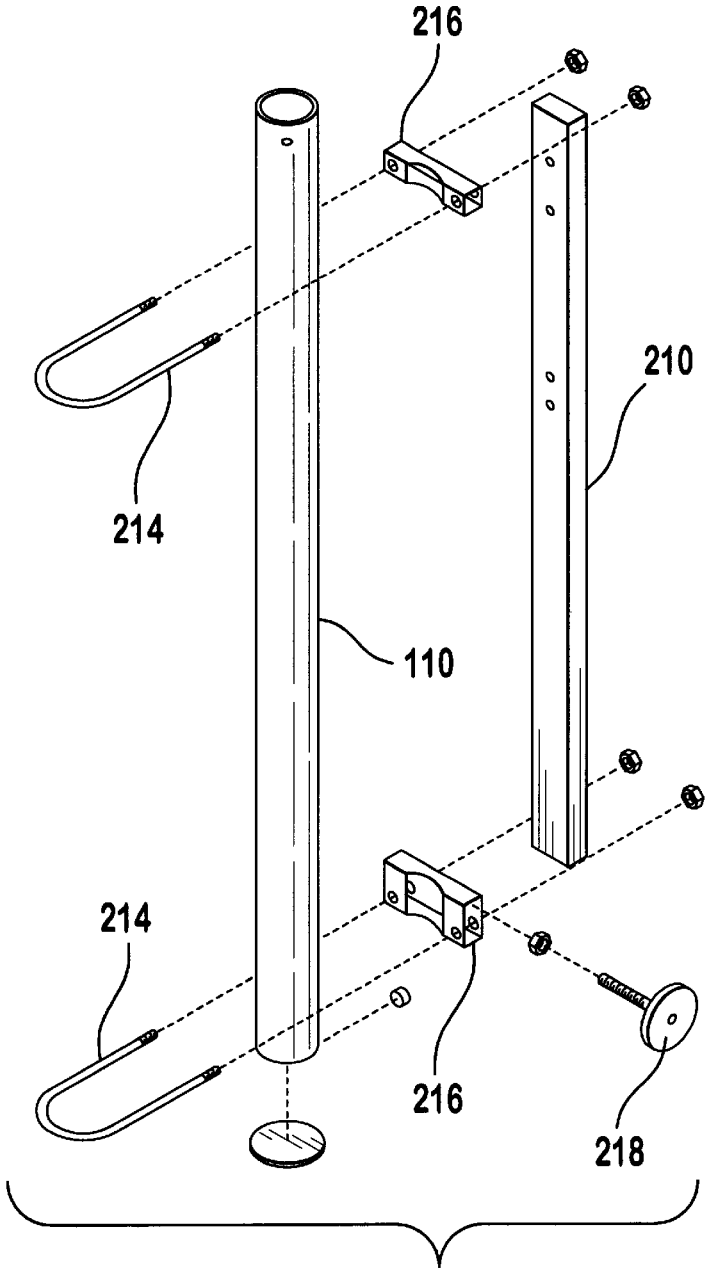
FIG. 3 is an exploded perspective view of the vertical support column and clamping system of the present invention.

The vertical support column 210, shown in FIG. 3, holds the hydraulic cylinder 110 of the hydraulic assembly 100 firmly in place through the use of U-bolt assemblies 212 which preferably engage upper and lower portions of the cylinder 110. The U-bolt assemblies 212 use a combination of a U-bolt 214 and an opposed cradle 216 to secure the cylinder 110 to the support column 210. At its bottom end, the support column 210 has a pool wall engaging element 218 which helps prevent displacement of the lift and is adjustable to establish the vertical orientation of the cylinder 110 in a generally parallel relationship to a vertical pool wall. The support column 210 is secured to the pool deck by the deck support 230.

The deck support 230 includes a first support member 232, a deck engaging member 240, and a second support member 250. The first support member 232 is attached, to the support column 210, so that it projects from the support column 210 in generally the same direction as the pool wall engaging element 218 i.e. roughly perpendicular to the support column 218 and the hydraulic cylinder 110. The support column 210 also allows for vertical adjustment of the hydraulic assembly 100 with respect to water level or deck level. The first deck support member 232 is preferably rigidly attached to the support column 210 in two places, one at deck level and a second placed above deck level for enhancing vertical stability. The deck engaging member 240 is adjustably affixed to the first support member 232 at an end opposite the support column 210. The deck engaging member 240 preferably is in the form of a T-shape, having its central element connected to the first support member 232. The first support member 232 is adjustable with respect to the deck engaging member 240 so that the distance from the pool wall can be modified as needed.

Extending end portions 244 with mounting apertures 245 enable the deck engaging member 240 to be secured to the deck by appropriate means such as bolts with bolt anchors to be installed in the deck. Preferably, wheels 246 are provided on the extending end portions 244 of the deck engaging member 240, so that the assembled lift can be temporarily removed by removing the deck securing bolts from apertures 245, tilting the lift 10 onto the wheels and rolling it to a storage location. Re-installing is then simply a matter of rolling the lift 10 to its installed position and rebolting the deck engaging member 240 to the pool deck.

The second deck support member 250 is affixed to a medial location of the first deck support member 232 and extends perpendicularly therefrom. Preferably, the second support member 250 is generally L-shaped, with a vertical portion 252 affixed to the first support member 232 via bolts or other means. The mounting location of the second deck support member 250 to the first deck support member 232 is adjustable to accommodate the position of the lift, the pool wall, or the design of the pool edge. A horizontal portion 254 of the second support member 250 includes an extendable slide member 255 to which is attached a pressure foot 256 for engaging the deck opposite the vertical portion 252 of the second deck support member 240. The slide member 255 is adjustable so that the pressure foot 256 may be positioned in a preferred location corresponding to the midpoint of a load in the lift assembly as it travels over the pressure foot 256 or beyond the arc of travel of the mid-point. For added strength, the second deck support member 240 includes corner braces 257 at the connection of its vertical and horizontal portions 252, 254.

The support assembly 200 maintains the working hydraulic system in a stable relationship with the pool deck. The arrangement of the support components prevents the hydraulic system and lift assembly from being displaced from their intended positions throughout the lift cycle, even under very heavy loads. The adjustability of the support assembly 200 facilitates installation at odd shaped pools, deck surfaces, and pool edges which can be raised or recessed from the deck.

The lift assembly 300 transports a load between raised and lowered positions. Preferably, a seat 310 with a foot rest 312 is used in the lift assembly as the load bearing component. Alternatively, a stretcher may be used in place of the seat 310. The seat 310 is connected to a cantilevered support member 320 which abuts the cylinder 110 of the hydraulic assembly 100 via an attached concave roller 340. Forces generated by a cantilevered load placed in the seat are directed toward the roller 340 which dissipates the forces through the cylinder 110 to the support assembly 200. The use of such rollers 340 is well known in the art, for example, such rollers are taught in U.S. Pat. No. 3,166,282. The cantilevered support member 320 is attached at its roller end to the lower end of a pole assembly 350. The pole assembly 350 is attached to the upper portion of the piston rod 134 such that the entire lift assembly is raised, lowered and rotated in direct response to the displacement of the piston rod 134.

As best seen in FIG. 4, in use, the lift assembly begins in a raised position for allowing access to the pool. In the uppermost raised position, the load carrying component of the lift assembly, i.e. the seat 310, is roughly parallel to the pool wall. In this position, a disabled person can easily back into the seat 310 with the comfort of the deck D on all sides of the seat 310. In conventional designs which only rotate 90°, the lift seat is commonly raised only to the pool edge so that only the front portion of the seat is in close proximity to the pool deck and the person using the lift has a disconcerting view of water just below the seat.

From the initial raised position, the seat 310 rotates while traveling downward. As the piston 132, piston rod 134, and lift assembly rotate 300, the seat 310 passes over the second deck support member 250. Preferably, the pressure foot 256 of the second support member 250 is installed at a location directly under or at least slightly beyond (i.e. further away from the cylinder 110) the mid-line of the seat 310 as the seat passes over head as illustrated in FIG. 4. The pressure foot 256 aids in preventing the cylinder 110 from being dislocated from its vertical position.

Continuing in its descent, the lift assembly rotates until it has completed 180° of rotation and is opposite its original position as indicated in phantom in FIG. 4. From this point, the lift descends straight downward in the pool P until the end of the cycle. The movement of the seat 310 corresponds directly to the configuration of the raised track 136 on the piston rod 134. Once the lift is in its lowered position, the passenger is in the pool and free to swim away.

To exit the pool, the reverse cycle is performed. In this case, the lift cycle is powered by water pressure.

To avoid problems of loose or wobbly conditions at the upper position, the track 136 is selectively configured as shown in FIGS. 5–7. The straight portions 138, 142 of the raised track 136 on the piston rod 134 are wider than the curved portion 140. FIG. 6 illustrates the wider straight portions in relation to the notched end cap 120. The wider, straight track creates upper and lower portions of the cycle which are less likely to sway. This is especially important during loading and unloading of the lift, i.e. when it is in its fully raised or fully lowered positions. Preferably, the raised track is ¼ inches high and ⅝ inches wide in straight portions 138, 142 necking down to a width of ½ inches for the intermediate portion 140. The corresponding end cap preferably is 3 inches thick having a track engaging notch 124 which is ¾ inches wide.

To further secure the seat 310 in its fully raised and lowered positions, an interlocking key system is used. As seen in FIG. 7, the piston rod 134 is provided with a raised key 148, opposite the lower portion 142 of the raised track 136. This raised key 148 engages a second notch 126 in the end cap 120. Together, the interlocking key 148, the wider raised track 136 and the relatively thick and cap 120 provide enhanced stability to the lift assembly in the uppermost position for loading and unloading of the lift. An interlocking key (not shown) may also be disposed opposite the upper straight portion 138 of the track 136 to provide enhanced stability in the lowermost lift position. Preferably, the raised keys are ⅝ inches wide and the key receiving notch 148 in the polyolefin cap 120 is also ⅝ inches wide for a snug, secure fit.

Specific compositions, methods, or embodiments discussed in this specification are intended to be only illustrative of the claimed invention. Variations of any of these that would be readily apparent to a person of skill in the art based upon the teachings of this specification and the skills of a person of ordinary skill in the relevant art are intended to be within the scope of the disclosed invention.

What is claimed is:

1. A lift apparatus to assist access to and egress from a pool or spa comprising:

a hydraulic assembly including:

a cylinder, and a piston for both axial and radial displacement;

a support assembly for supporting said hydraulic assembly in a vertical orientation extending at least partially within a pool, including:

a first deck support member projecting perpendicularly from said hydraulic assembly and having a first deck engaging member proximate an end of said first member opposite said hydraulic assembly; and a second deck support member extending substantially perpendicularly from a medial portion of said first member having a second deck engaging member proximate an end of said second member opposite said first member; and a lift assembly affixed to said piston for displacement of a load carrying component of said lift assembly between a lowered position opposite said deck support and a raised position above said deck support such that said load carrying component travels over said deck support second member when it is displaced between its lowered and raised positions.

2. A lift apparatus according to claim 1 wherein said lift assembly includes:

a cantilevered support on which said load carrying component is mounted; and a roller mounted opposite said cantilevered support in supporting engagement with said cylinder.

3. A lift apparatus according to claim 1 wherein said load carrying component is a seat with a foot rest.

4. A lift apparatus according to claim 1 wherein said load carrying component is a stretcher.

5. A lift apparatus according to claim 1 wherein said cylinder includes an end cap which has a central aperture having a track receiving notch; and said piston includes a piston rod extending through said cylinder cap aperture, said piston rod having a raised track with a straight upper portion, a curved middle portion, and a straight lower portion such that said raised track engages said notch whereby as said piston rod is vertically displaced, it rotates according to the path of said raised track.

6. A lift apparatus according to claim 5 wherein said upper and lower straight portions of said raised track have a width greater than said curved track portion.

7. A lift apparatus according to claim 5 wherein said end cap aperture has a second notch opposing said track receiving notch and said piston rod has a raised key opposing at least one of said straight track portions such that said raised key engages said second notch when said lift assembly load carrying component is in its respective raised or lowered position.

8. A lift apparatus according to claim 7 wherein said raised key is opposite said lower track portion such that said raised key engages said second notch when said load carrying component is in its raised position.

9. A lift apparatus according to claim 1 wherein said load carrying component has a load mid-point and said second deck engaging member is disposed on or beyond an arc of travel of said load mid-point.

10. A lift apparatus according to claim 1 wherein said piston includes a hollow piston rod having a reinforcing bar with a rectangular cross-section disposed therein, said reinforcing bar having a narrow side and being disposed within said piston rod such that said narrow side faces said load carrying component.

11. A lift apparatus according to claim 1 wherein said support assembly further includes a support column having a pool wall engaging support element proximate a bottom end and means for adjustably holding said hydraulic assembly in a vertical orientation; and wherein said first deck support member projects from said support column in a substantially parallel direction to said pool wall engaging element.

12. A lift apparatus according to claim 11 wherein said means for adjustably holding said hydraulic lift comprises a U-bolt clamping system.

13. A lift apparatus according to claim 11 wherein said first support member is attached to said support column at at least two vertically spaced points above deck level.

14. A lift apparatus according claim 1 wherein said first support member is adjustable with respect to said first deck engaging member and said first deck engaging member has lateral members perpendicular to said first support member which include wheels for facilitating temporary removal and re-installation of said lift apparatus.

15. A lift apparatus according to claim 1 wherein said second member has an adjustable horizontal member terminating in said second deck engaging member.

16. The apparatus of claim 15 wherein said second deck engaging member is adjusted to a position directly below or beyond a midpoint of said load bearing component as it passes overhead.

17. A lift apparatus to assist access to and egress from a pool or spa comprising:

a hydraulic assembly including:

a cylinder having an upper end cap with a notched aperture, and a piston including an internally reinforced piston rod for both longitudinal and radial displacement through said notched aperture of said end cap;

said piston rod having a raised track for controlling displacement via engagement with said end cap;

a support assembly for supporting said hydraulic lift assembly, including:

a support column having a pool wall engaging support element proximate a bottom end, and means for adjustably holding said hydraulic lift assembly in a vertical orientation; and a deck support rigidly connected to said support column including:

a first deck support member projecting from said support column in a substantially parallel direction to said pool wall engaging element and having a first deck engaging member proximate an end of said first member opposite said support column; and a second deck support member extending substantially perpendicularly from a medial portion of said first deck support member having a second deck engaging member proximate an end of said second member opposite said first member; and a lift assembly affixed to said piston having a load bearing component for displacement by said hydraulic assembly between a lowered position opposite said deck support and a raised position above said deck support such that said lift assembly load bearing component travels over said deck support second member when it is displaced between its lowered and raised positions.

18. A lift apparatus according to claim 17 wherein said second deck engaging member is located at a position directly beneath or beyond a midpoint of said load bearing component as it passes overhead.

19. A lift apparatus according to claim 16 wherein said internally reinforced piston rod includes a reinforcing bar, said reinforcing bar has a rectangular cross-section with a narrow side and said reinforcing bar is disposed within said piston rod such that said narrow side faces said load carrying component.

* * * * *